US008893763B2

(12) United States Patent
Huang

(10) Patent No.: US 8,893,763 B2
(45) Date of Patent: Nov. 25, 2014

(54) PULL CORD DEVICE AND WINDOW COVERING INCLUDING THE SAME

(71) Applicant: Taicang Kingfu Plastic Manufacture Co., Ltd., Taicang (CN)

(72) Inventor: Szu-Chang Huang, Changhua County (TW)

(73) Assignee: Taicang Kingfu Plastic Manufacture Co., Ltd., Taicang (CN)

( * ) Notice: Subject to any disclaimer, the term of this patent is extended or adjusted under 35 U.S.C. 154(b) by 81 days.

(21) Appl. No.: 13/796,756

(22) Filed: Mar. 12, 2013

(65) Prior Publication Data

US 2014/0083631 A1 Mar. 27, 2014

(30) Foreign Application Priority Data

Sep. 26, 2012 (CN) ..... 2012 2 0496408 U

(51) Int. Cl.
*E06B 9/30* (2006.01)
*E06B 9/80* (2006.01)
*E06B 9/322* (2006.01)

(52) U.S. Cl.
CPC . *E06B 9/322* (2013.01); *E06B 9/80* (2013.01); *E06B 2009/3222* (2013.01)
USPC ..... 160/170; 160/178.1 R

(58) Field of Classification Search
USPC ..... 160/170, 291, 296, 293.1, 294, 299, 160/305; 192/45.008, 223.2, 216
See application file for complete search history.

(56) References Cited

U.S. PATENT DOCUMENTS

| | | | | |
|---|---|---|---|---|
| 4,513,805 | A * | 4/1985 | Mase | 160/299 |
| 5,586,631 | A * | 12/1996 | Benthin | 192/223.2 |
| 6,443,210 | B1 * | 9/2002 | Welfonder | 160/313 |
| 6,571,853 | B1 * | 6/2003 | Ciuca et al. | 160/170 |
| 7,370,741 | B2 * | 5/2008 | Shimomura et al. | 192/42 |
| 7,406,995 | B2 * | 8/2008 | Huang | 160/170 |
| 8,051,960 | B2 * | 11/2011 | Nakajima | 188/82.7 |
| 8,172,055 | B2 * | 5/2012 | Satou | 192/45.008 |
| 8,356,653 | B2 * | 1/2013 | Fu-Lai et al. | 160/84.05 |
| 8,448,767 | B2 * | 5/2013 | Ando | 192/45.008 |
| 8,485,332 | B2 * | 7/2013 | Shirataki et al. | 192/45.016 |
| 8,622,184 | B2 * | 1/2014 | Sakai et al. | 192/45.008 |
| 2009/0078380 | A1 * | 3/2009 | Cheng | 160/291 |

* cited by examiner

*Primary Examiner* — Katherine Mitchell
*Assistant Examiner* — Johnnie A Shablack
(74) *Attorney, Agent, or Firm* — Faegre Baker Daniels LLP

(57) ABSTRACT

A one-way damper unit of a pull cord device includes a unidirectional clutch that is disposed in a housing to form a liquid-filled gap therewith and that includes: a casing formed with deep and shallow groove portions; a main shaft having an insert segment extending into the casing and a connecting segment extending outwardly of the casing for connecting to a driven wheel; and a clutching member including a clutching body that extends into the groove and that has a cross-sectional dimension shorter than a distance between the insert segment and the deep groove portion, and longer than a distance between the insert segment and the shallow groove portion.

9 Claims, 9 Drawing Sheets

PULL CORD DEVICE AND WINDOW COVERING INCLUDING THE SAME

CROSS-REFERENCE TO RELATED APPLICATION

This application claims priority of Chinese Application No. 201220496408.9, filed on Sep. 26, 2012.

BACKGROUND OF THE INVENTION

1. Field of the Invention

The present invention relates to a window covering, more particularly to a window covering provided with a pull cord device.

2. Description of the Related Art

U.S. Pat. No. 7,406,995B2 discloses a pull cord device for controlling raising and lowering of a base rail of a window covering. The pull cord device includes a locking wheel having a toothed segment turnable between locked and unlocked positions to engage and disengage from a cord spool, respectively, a cord-release controlling member having a cord retaining region to engage a pull cord to be movable along a linear running path when the pull cord is pulled in the unlocked position, a guideway disposed in the locking wheel, and including an angularly extending first route and a looped route, a guided member having a key end disposed in the guideway, and a linkage coupling the controlling member with the locking wheel such that when the controlling member is moved, the locking wheel is turned from the locked position to the unlocked position, and such that, in the unlocked position, the cord retaining region remains unmoved in each of the regions in the looped route.

Although the pull cord device is capable of retaining releasably the base rail at a desired height, a braking effect of the pull cord device is not functional when the base rail is being lowered. Therefore, downward moving speed of the base rail may be too fast especially when the combined weight of the base rail and slats of the window covering is greater than the restoring force of a coil spring of the pull cord device, which can be a cause of injury to a person or damage to an object under the base rail.

SUMMARY OF THE INVENTION

Therefore, an object of the present invention is to provide a pull cord device for a window covering that may alleviate the above drawback of the prior art.

According to the present invention, a pull cord device is adapted to control raising and lowering of a base rail relative to a header rail of a window covering in an upright direction. The pull cord device comprises a container, a spring driving unit, a pull cord, a braking unit, and a one-way damper unit.

The container is to be disposed on one of the base rail and the header rail. The spring driving unit is disposed in the container and includes a cord spool and a spring motor that biases the cord spool to rotate in a cord-winding direction. The pull cord has one end coupled to the cord spool, extends out of the container, and further has an opposite end to be coupled to the other one of the base rail and the header rail. The braking unit is disposed in the container and is operatively associated with the cord spool and the pull cord for retaining releasably the base rail at a desired height relative to the header rail. The one-way damper unit includes a housing, a unidirectional clutch, a damping liquid, and a driven wheel.

The housing is mounted to the container. The unidirectional clutch is disposed in the housing, forms a gap with the housing, and includes: a casing having an inner casing surface formed with a groove that extends at an angle with respect to an axis and that has a deep groove portion and a shallow groove portion angularly spaced apart from the deep groove portion, the shallow groove portion having a depth with respect to the axis that is shallower than that of the deep groove portion; a main shaft having an insert segment extending into the casing along the axis, and a connecting segment extending from the insert segment outwardly of the casing; and a clutching member disposed in the casing. The clutching member includes: a fixing frame formed with a mounting slot; a clutching body disposed in the mounting slot, contacting the insert segment of the main shaft, extending into the groove, and having a cross-sectional dimension shorter than a smallest distance between an outer surface of the insert segment and a groove bottom of the deep groove portion, and longer than a largest distance between the outer surface of the insert segment and a groove bottom of the shallow groove portion; and a spring member disposed between the fixing frame and the clutching body for biasing the clutching body toward the shallow groove portion. The damping liquid fills the gap between the housing and the unidirectional clutch. The driven wheel is coupled to the connecting segment of the main shaft, and is driven rotatably by the spring driving unit.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
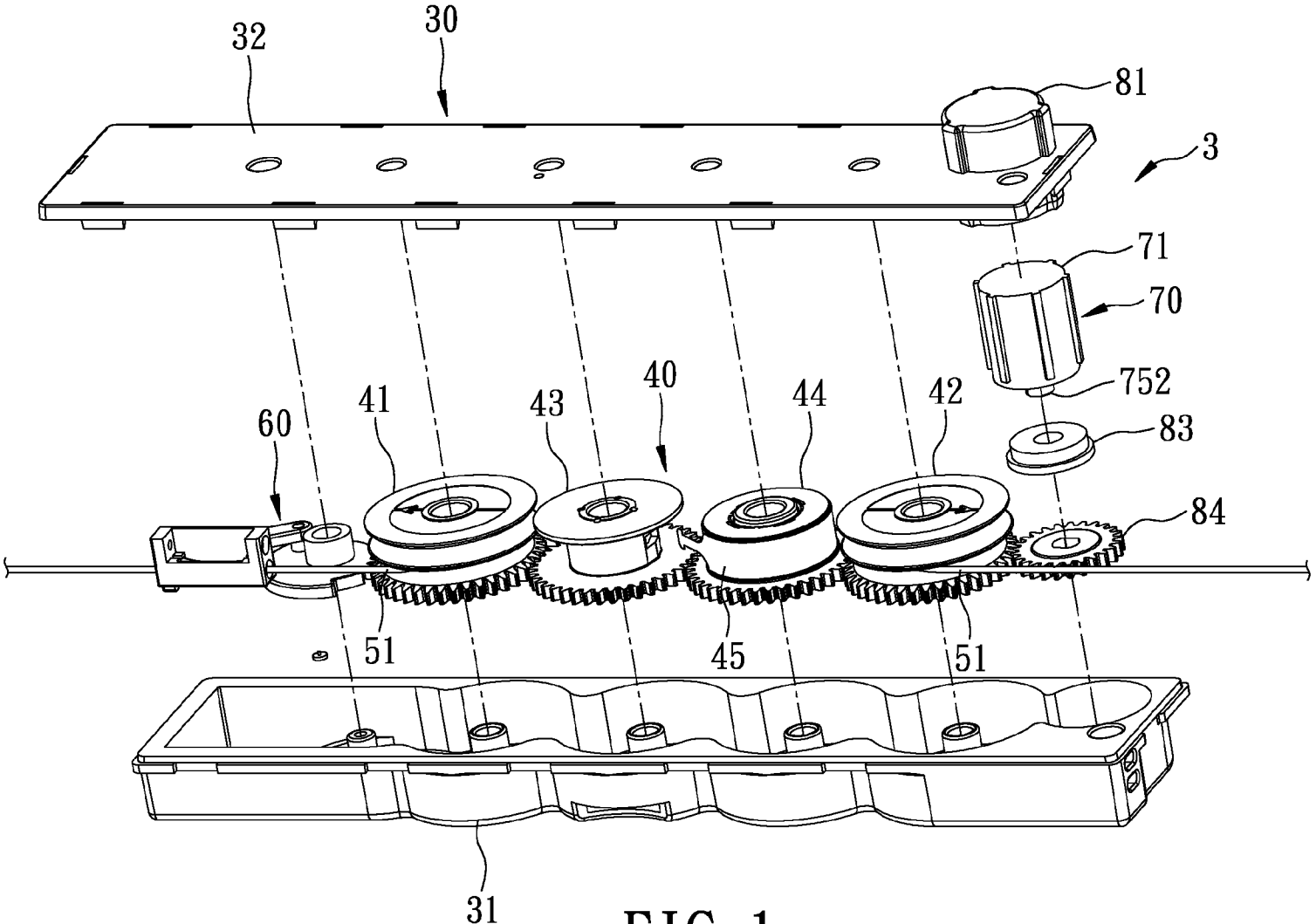
FIG. 1 is a partly exploded perspective view of the preferred embodiment of a pull cord device according to the present invention.
Figure 2:
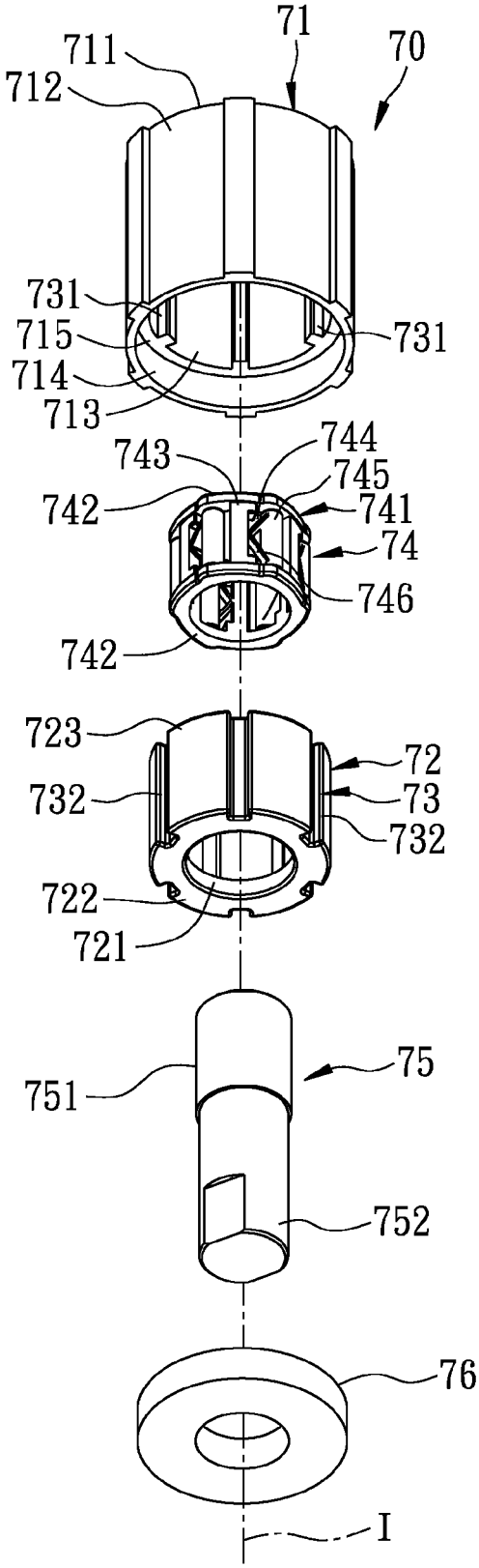
FIG. 2 is an exploded, perspective view of a unidirectional clutch of the preferred embodiment.
Figure 3:
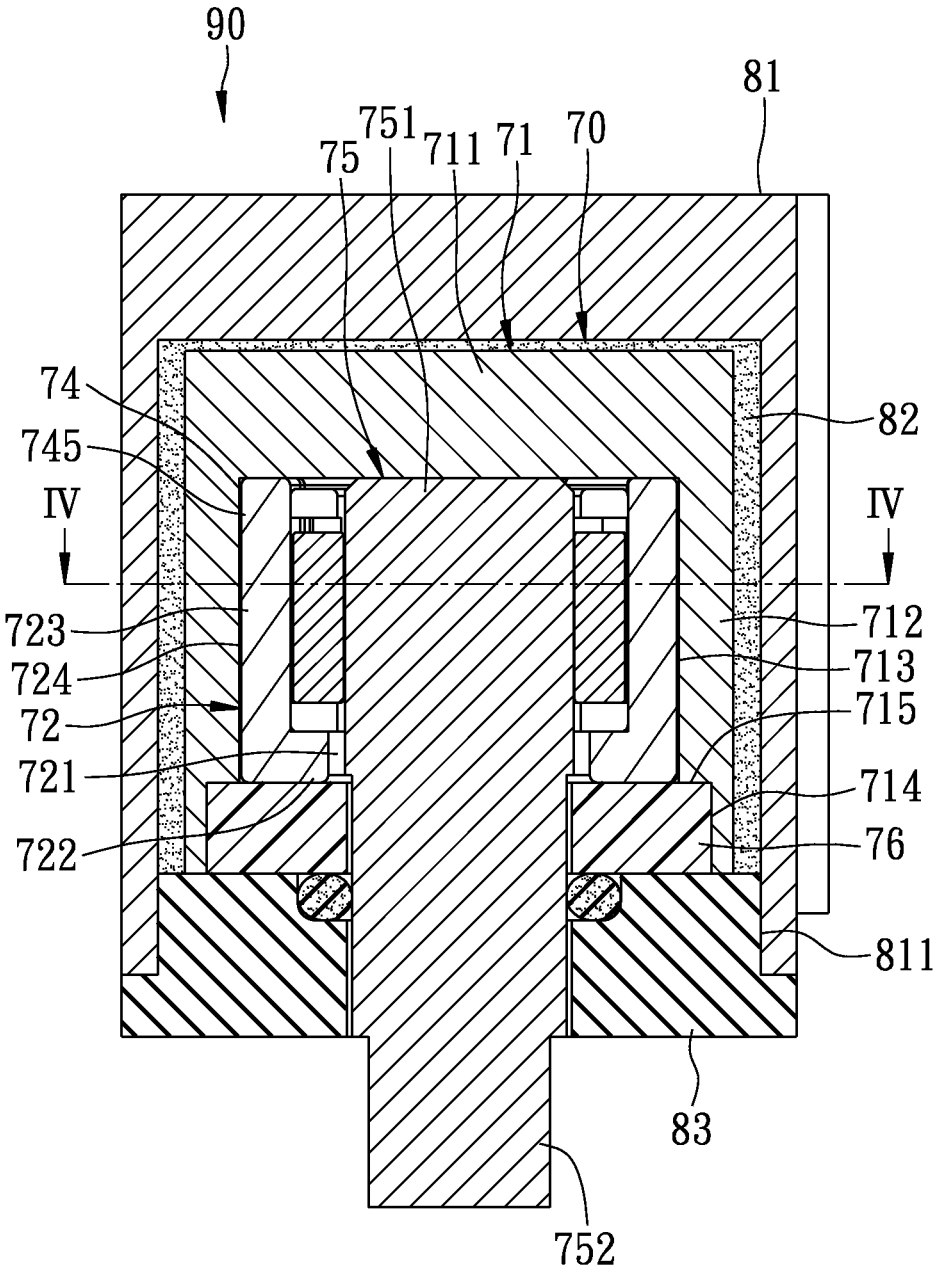
FIG. 3 is a vertical sectional view of a one-way damper unit of the preferred embodiment.

Referring to FIGS. 1 to 6, a window covering 2 is shown to comprise a header rail 21, a base rail 22, a plurality of slats 23, and a pull cord device 3.

The base rail 22 is movable relative to the header rail 21 in an upright direction. The slats 23 are disposed between the header rail 21 and the base rail 22. The preferred embodiment of the pull cord device 3 according to this invention includes a container 30, a spring driving unit 40, pull cords 50, a braking unit 60, and a one-way damper unit 90. The container 30 is disposed on the header rail 21 in this embodiment, but may be disposed on the base rail 22 in other embodiments of this invention. In this embodiment, the container 30 includes a hollow base part 31 and a cover part 32 to cover an open side of the base part 31. The spring driving unit 40 is disposed in the container 30, and includes first and second cord spools 41, 42 and a spring motor that biases the first and second cord spools 41, 42 to rotate in a cord-winding direction. In this embodiment, the spring motor includes a drive wheel 43, a take-up wheel 44, and a coil spring 45. In this embodiment, each pull cord 50 has one end 51 coupled to a respective one of the first and second cord spools 41, 42, extends out of the container 30 and through the slats 23, and further has an opposite end 52 guided by a respective guide seat 24 on the base rail 22 and connected to the end 52 of the other pull cord 50. It is noted that, when the container 30 is disposed on the base rail 22, the ends 52 of the pull cords 50 are coupled to the header rail 21. The braking unit 60 is disposed in the container 30, and is operatively associated with the first and second cord spools 41, 42 and the pull cords 50 for retaining releasably the base rail 22 at a desired height relative to the header rail 21.

In this embodiment, the configurations and operations of the spring driving unit 40, the pull cords 50, and the braking unit 60 are similar to those described in U.S. Pat. No. 7,406,995B2. Since the feature of the present invention does not reside in the specific constructions of the spring driving unit 40 and the braking unit 60, which may be readily appreciated in light of the disclosure in U.S. Pat. No. 7,406,995B2, a detailed description of the spring driving unit 40 and the braking unit 60 is omitted herein for the sake of brevity. Moreover, the present invention should not be limited to the specific spring driving unit 40 and the specific braking unit 60 disclosed in U.S. Pat. No. 7,406,995B2.

The pull cord device 3 of the present invention is characterized by the one-way damper unit 90.

The one-way damper unit 90 includes a unidirectional clutch 70, a housing 81, a damping liquid 82, a sealing lid 83, and a driven wheel 84. The unidirectional clutch 70 is disposed in the housing 81, and includes a casing, a coupling unit 73, a clutching member 74, a main shaft 75, and an annular plug 76.

The casing includes an outer casing part 71 and an inner casing part 72 disposed in and coupled co-rotatably to the outer casing part 71. The outer casing part 71 includes an end wall 711 and an outer surrounding wall 712 extending from a periphery of the end wall 711 parallel to an axis (I) and cooperating with the end wall 711 to confine a receiving space. The receiving space has a first section 713 proximate to the end wall 711 and configured to receive the inner casing part 72, and a second section 714 wider than the first section 713 and configured to receive the annular plug 76. The outer surrounding wall 712 has an inner wall surface that is formed with an open end distal from the end wall 711 of the outer casing part 71, and that is formed with a shoulder 715 at a junction of the first and second sections 713, 714 of the receiving space of the outer casing part 71.

The inner casing part 72 of the casing is received in the first section 713 of the receiving space, and includes an annular end flange 722 that defines a shaft hole 721, and an inner surrounding wall 723 that extends from an outer periphery of the end flange 722 parallel to the axis (I). The inner surrounding wall 723 has an inner casing surface 724 formed with a plurality of grooves 725 that extend at an angle with respect to the axis (I) and that each have a deep groove portion 726 and a shallow groove portion 727 angularly spaced apart from the deep groove portion 726. The shallow groove portion 727 has a depth with respect to the axis (I) that is shallower than that of the deep groove portion 726.

The coupling unit 73 couples the inner surrounding wall 723 of the inner casing part 72 co-rotatably to the outer surrounding wall 712 of the outer casing part 71. In this embodiment, the coupling unit 73 includes a plurality of angularly spaced apart keys 731 that extend parallel to the axis (I) and that are formed on the inner surrounding wall 723, and a plurality of angularly spaced apart keyways 732 that extend parallel to the axis (I), that are formed in the outer surrounding wall 712, and that engage the keys 731, respectively. The positions of the keys 731 and the keyways 732 may be interchanged in other embodiments of this invention.

The clutching member 74 is disposed in the inner casing part 72 and abuts against the annular end flange 722, and includes a fixing frame 741 formed with a plurality of angularly spaced apart mounting slots 744, a plurality of clutching bodies 745 disposed movably and respectively in the mounting slots 744 and respectively extending into the grooves 725, and a plurality of spring members 746. The fixing frame 741 includes a pair of fixing rings 742, and a plurality of angularly spaced apart connecting members 743 interconnecting the fixing rings 742 and extending parallel to the axis (I). The mounting slots 744 are cooperatively defined by the fixing rings 742 and the connecting members 743.

Each spring member 746 is disposed between a respective connecting member 743 and a respective clutching body 745 for biasing the respective clutching body 745 away from the respective connecting member 743. In other words, each spring member 746 is for biasing the respective clutching body 745 toward the shallow groove portion 727 of the respective groove 725. In this preferred embodiment, each spring member 746 is a spring plate.

In this preferred embodiment, the number of each of the grooves 725, the clutching bodies 745 and the spring members 746 is six.

The main shaft 75 has an insert segment 751 that extends into the shaft hole 721 and the clutching member 74 along the axis (I) and that contacts the clutching bodies 745, and a connecting segment 752 extending from the insert segment 751 outwardly of the outer casing part 71.

Figure 7:
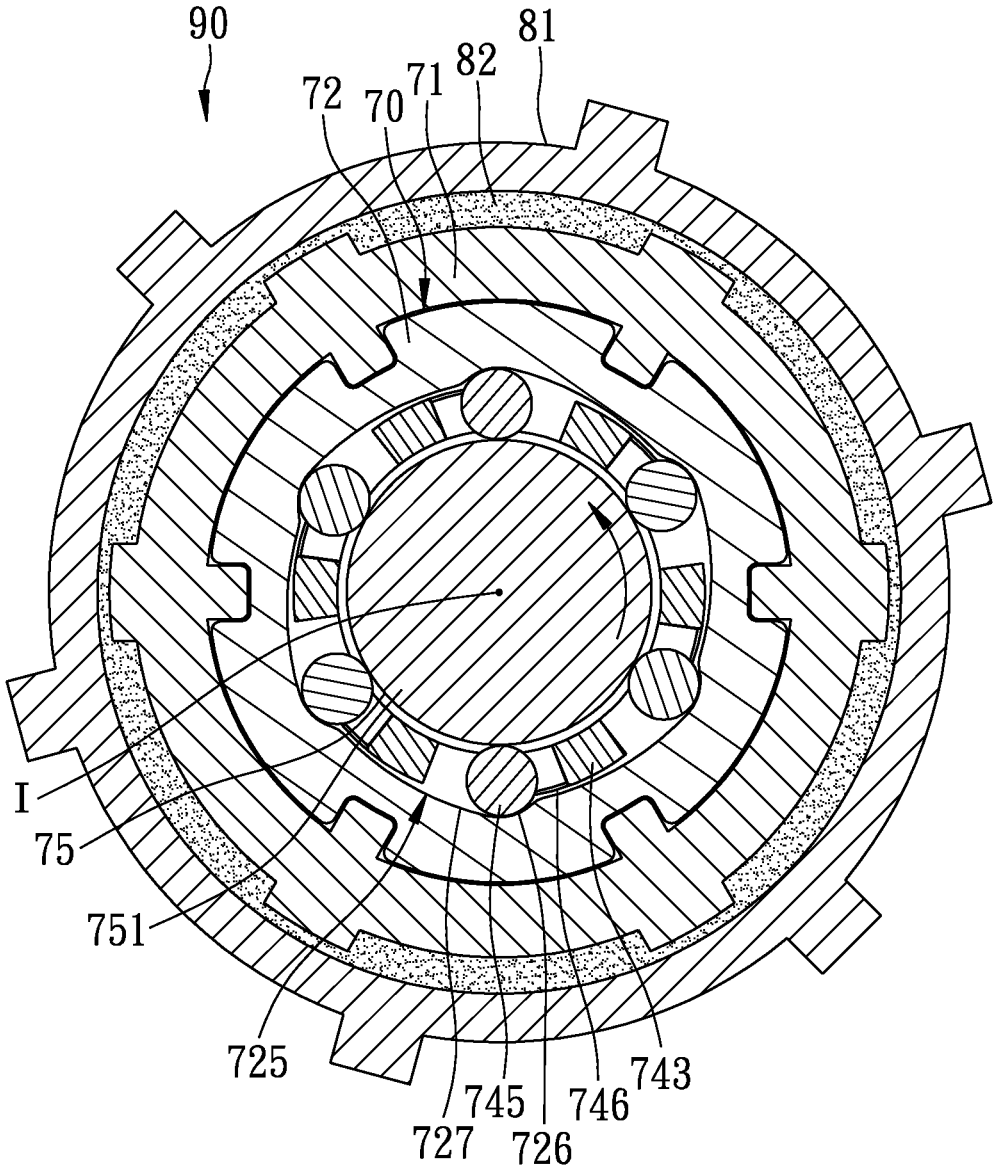
FIG. 7 is another horizontal sectional view of the one-way damper unit, illustrating a state where the main shaft is incapable of driving rotation of the casing.
Figure 8:
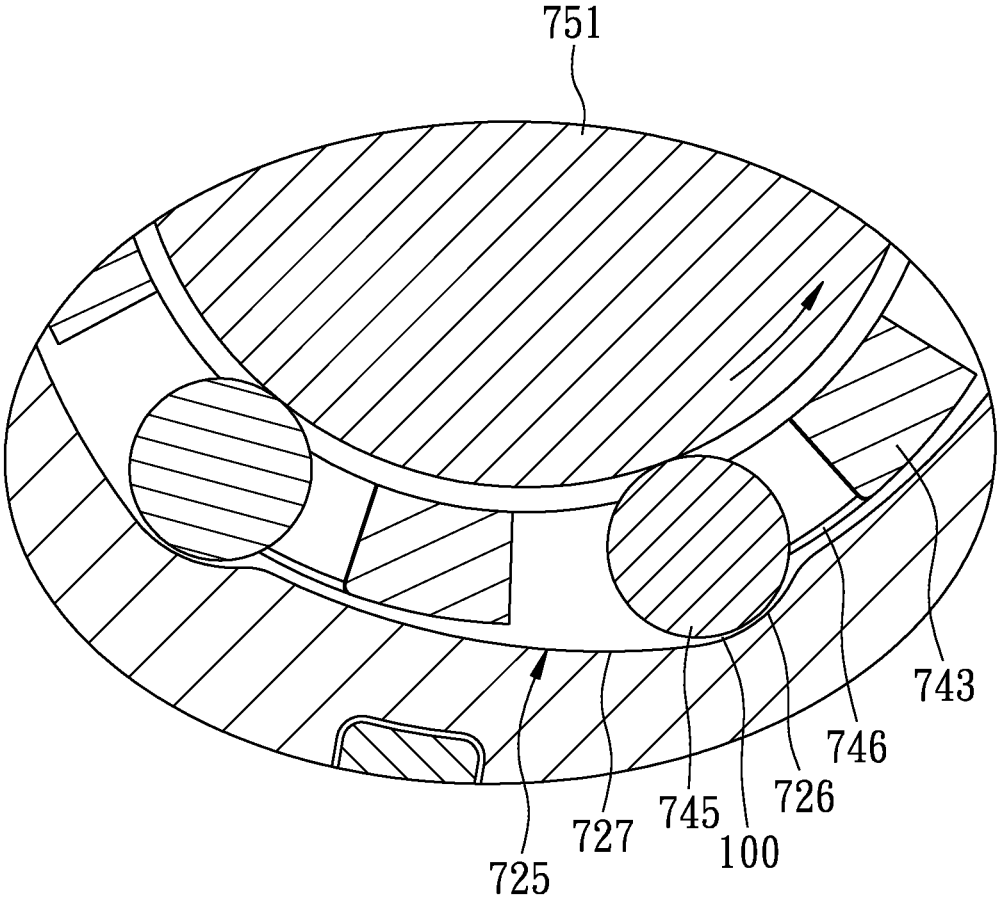
FIG. 8 is an enlarged view of a portion in FIG. 7, the clutching body disposed in a deep groove portion.

Referring to FIGS. 7 and 8, each clutching body 745 has a cross-sectional dimension (i.e., a diameter) that is shorter than a smallest distance between an outer surface of the insert segment 751 and a groove bottom of the deep groove portion 726 of the respective groove 725, and that is longer than a largest distance between the outer surface of the insert segment 751 and a groove bottom of the shallow groove portion 727 of the respective groove 725. Therefore, when the clutching body 745 enters into the deep groove portion 726, a clearance 100 is formed between the clutching body 745 and the groove bottom of the deep groove portion 726, and the main shaft 75 is disengaged from the inner casing part 72 such that the main shaft 75 is incapable of driving rotation of the casing of the unidirectional clutch 70 at this time. On the other hand, when the clutching body 745 enters into the shallow groove portion 727, the main shaft 75 is engaged with the inner casing part 72 such that the main shaft 75 is capable: of driving rotation of the casing of the unidirectional clutch 70 with respect to the axis (I), as best shown in FIGS. 4 and 5.

Referring back to FIGS. 1 to 3, the annular plug 76 is sleeved on the connecting segment 752 of the main shaft 75, is received in the second section 714 of the receiving space, and abuts against the shoulder 715 for cooperating with the connecting segment 752 to seal the open end of the casing of the unidirectional clutch 70.

The housing 81 is mounted to the cover part 32 of the container 30. The unidirectional clutch 70 is disposed in the housing 81 and forms a gap with the housing 81. The damping liquid 82 fills the gap between the housing 81 and the unidirectional clutch 70. The sealing lid 83 is disposed at an open end 811 of the housing 81, through which the connecting segment 752 of the main shaft 75 extends, and forms a fluid-tight seal with the annular plug 76. The driven wheel 84 is coupled to the connecting segment 752 of the main shaft 75 and is driven rotatably by the spring driving unit 40.

Figure 4:
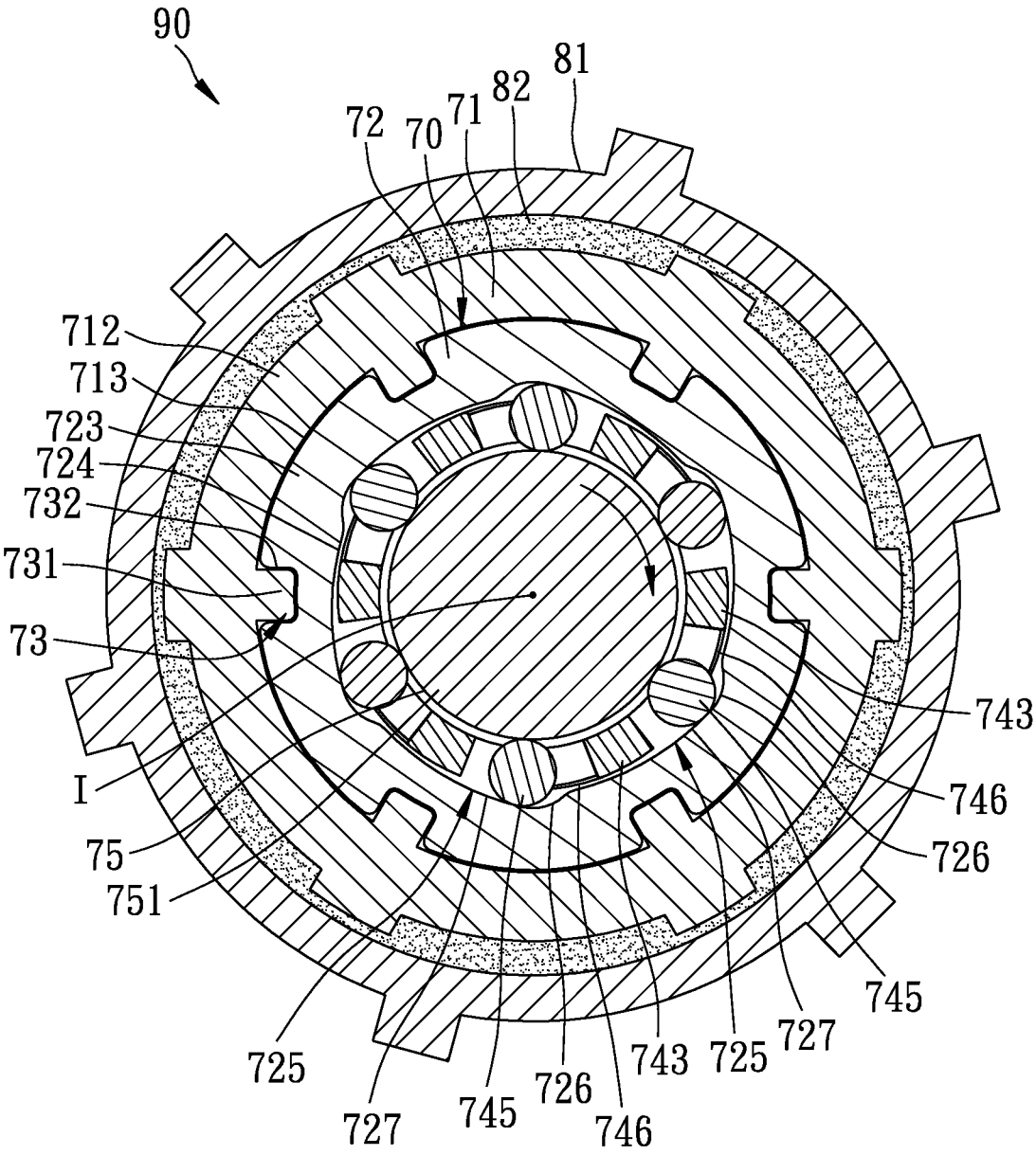
FIG. 4 is a horizontal sectional view of the one-way damper unit taken along line IV-TV in FIG. 3, illustrating a state where a main shaft is capable of driving rotation of a casing.
Figure 5:
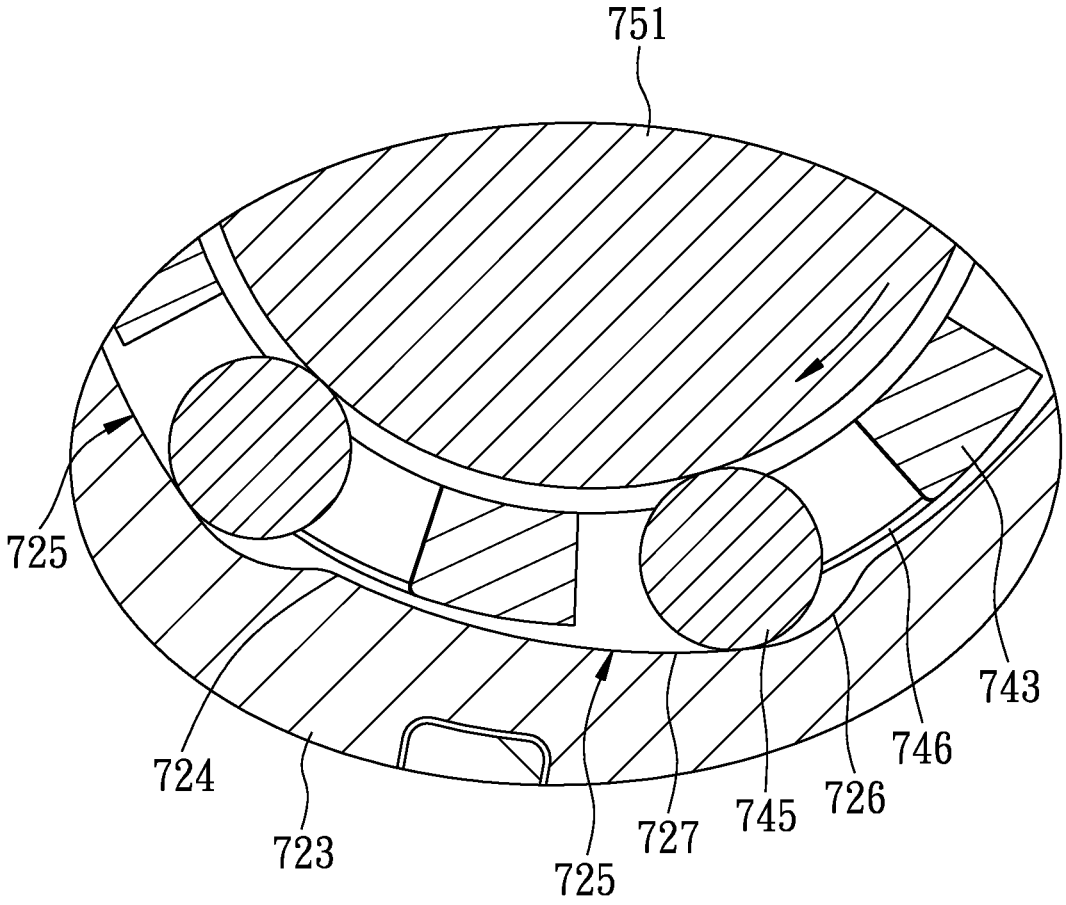
FIG. 5 is an enlarged view of a portion in FIG. 4, illustrating a clutching body disposed in a shallow groove portion.
Figure 6:
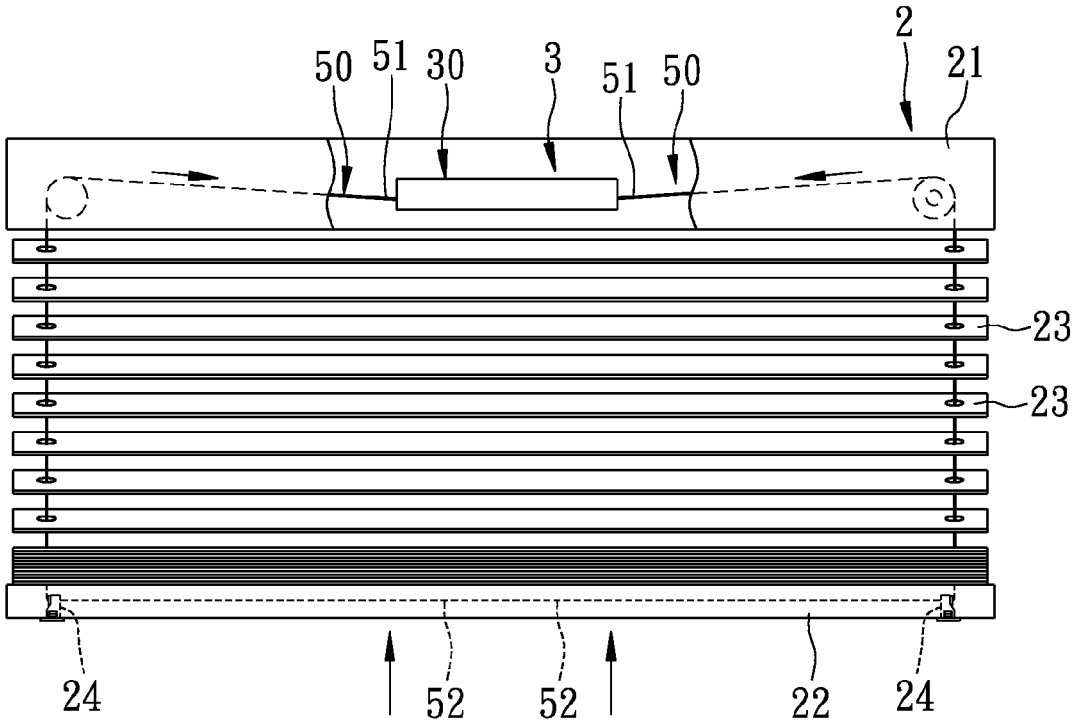
FIG. 6 is a front view of a window covering including the pull cord device of the preferred embodiment in a state where a base rail of the window covering is raised.

Referring to FIGS. 4 and 6, when the base rail 22 is retained at an initial height relative to the header rail 21, the clutching bodies 745, which are biased by the spring members 746 toward the shallow groove portions 727 of the grooves 725, are retained between the insert segment 751 of the main shaft 75 and the shallow groove portions 727 of the grooves 725.

Referring to FIGS. 1 and 6 to 8, to raise the base rail 22 and stack the slats 23 of the window covering 2, an operator merely needs to push upwardly the base rail 22 to drive the drive wheel 43 of the spring driving unit 40 to rotate in a clockwise direction by the restoring force of the coil spring 45. Accordingly, the first cord spool 41 and the take-up wheel. 44 are driven to rotate in a counter-clockwise direction, the second cord spool 42 is driven to rotate in the clockwise direction, and the driven wheel 84 of the one-way damper unit 90, that is coupled to the connecting segment 752 of the main shaft 75, is driven by the second cord spool 42 to rotate in the counter-clockwise direction, thereby driving the clutching bodies 745 to move in the counter-clockwise direction into the deep groove portions 726 of the grooves 725. At this time, the main shaft 75 is disengaged from the inner casing part 72 so that the main shaft 75 is able to rotate smoothly and the base rail 22 may be raised quickly.

Figure 9:
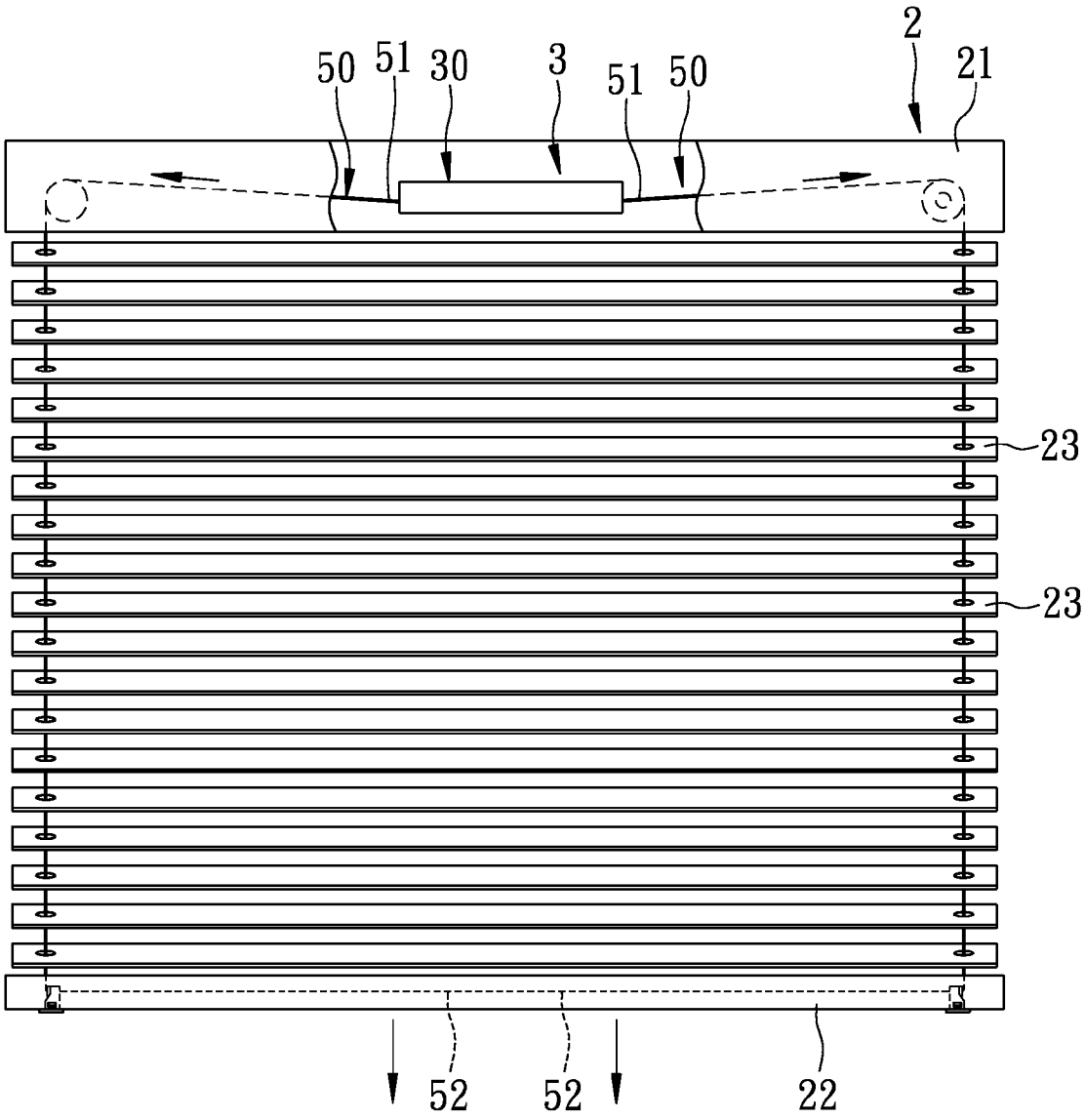
FIG. 9 is another front view of the window covering including the pull cord device of the preferred embodiment, but in a state where the base rail of the window covering is lowered.

Referring to FIGS. 4, 5 and 9, to lower the base rail 22 and expand the slats 23 of the window covering 2, the operator merely needs to pull downwardly the base rail 22 to drive the second cord spool 42 to rotate in the counter-clockwise direction by the pull cords 50. As a result, the driven wheel 84 of the one-way damper unit 90, that is coupled to the connecting segment 752 of the main shaft 75, is driven by the second cord spool 42 to rotate in the clockwise direction, thereby driving the clutching bodies 745 to move in the clockwise direction into the shallow groove portions 727 of the grooves 725. At this time, the main shaft 75 is engaged with the inner casing part 72 so that the outer and inner casing parts 71 and 72 rotate with the main shaft 75. Due to the damping liquid 82 between the housing 81 and the outer casing part 71, rotation of the main shaft 75 is slowed down so that unwinding of the pull cords 50 and lowering of the base rail 22 proceed at a relatively slower speed to thereby enhance safety.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A pull cord device adapted to control raising and lowering of a base rail relative to a header rail of a window covering in an upright direction, said pull cord device comprising:

a container to be disposed on one of the base rail and the header rail;

a spring driving unit disposed in said container and including a cord spool and a spring motor that biases said cord spool to rotate in a cord-winding direction;

a pull cord having one end coupled to said cord spool, extending out of said container, and further having an opposite end to be coupled to the other one of the base rail and the header rail;

a braking unit disposed in said container and operatively associated with said cord spool and said pull cord for retaining releasably the base rail at a desired height relative to the header rail; and a one-way damper unit including:

a housing mounted to said container;

a unidirectional clutch disposed in said housing, forming a gap with said housing, and having:

a casing having an inner casing surface formed with a groove that extends at an angle with respect to an axis and that has a deep groove portion and a shallow groove portion angularly spaced apart from said deep groove portion, said shallow groove portion having a depth with respect to the axis that is shallower than that of said deep groove portion;

a main shaft having an insert segment extending into said casing along the axis, and a connecting segment extending from said insert segment outwardly of said casing; and a clutching member disposed in said casing and including: a fixing frame formed with a mounting slot; a clutching body disposed in said mounting slot, contacting said insert segment of said main shaft, and extending into said groove, said clutching body having a cross-sectional dimension shorter than a smallest distance between an outer surface of said insert segment and a groove bottom of said deep groove portion, and longer than a largest distance between said outer surface of said insert segment and a groove bottom of said shallow groove portion; and a spring member disposed between said fixing frame and said clutching body for biasing said clutching body toward said shallow groove portion;

a damping liquid that fills said gap between said housing and said unidirectional clutch; and a driven wheel coupled to said connecting segment of said main shaft and driven rotatably by said spring driving unit.

2. The pull cord device as claimed in claim 1, wherein said fixing frame includes a pair of fixing rings, and a connecting member interconnecting said fixing rings and extending parallel to the axis, said mounting slot being defined by said fixing rings and said connecting member, said spring member being a spring plate disposed between said connecting member and said clutching body.

3. The pull cord device as claimed in claim 1, wherein said casing has an open end through which said connecting segment of said main shaft extends, and said unidirectional clutch further includes an annular plug that is disposed at said open end of said casing and that is sleeved on said connecting segment of said main shaft.

4. The pull cord device as claimed in claim 3, wherein said housing has an open end through which said connecting segment of said main shaft extends, and said one-way damper unit further includes a sealing lid disposed at said open end of said housing and forming a fluid-tight seal with said annular plug.

5. The pull cord device as claimed in claim 3, wherein said casing includes an outer casing part and an inner casing part disposed in and coupled co-rotatably to said outer casing part, said outer casing part including an end wall and an outer surrounding wall extending from a periphery of said end wall parallel to the axis and cooperating with said end wall to confine a receiving space, said receiving space having a first section proximate to said end wall and configured to receive said inner casing part, and a second section wider than said first section and configured to receive said annular plug.

6. The pull cord device as claimed in claim 5, wherein said outer surrounding wall has an inner wall surface formed with a shoulder at a junction of said first and second sections of said receiving space, said annular plug abutting against said shoulder.

7. The pull cord device as claimed in claim 5, wherein said inner casing part includes an annular end flange that defines a shaft hole through which said connecting segment of said main shaft extends, and an inner surrounding wall that extends from an outer periphery of said end flange parallel to the axis, said unidirectional clutch further including a coupling unit for coupling said inner surrounding wall co-rotatably to said outer surrounding wall.

8. The pull cord device as claimed in claim 7, wherein said coupling unit includes a key that extends parallel to the axis and that is formed on one of said inner surrounding wall and said outer surrounding wall, and a keyway that extends parallel to the axis, that is formed in the other one of said inner surrounding wall and said outer surrounding wall, and that engages said key.

9. A window covering comprising:

a header rail;

a base rail movable relative to said header rail in an upright direction;

a plurality of slats disposed between said header rail and said base rail;

a container disposed on one of said base rail and said header rail;

a spring driving unit disposed in said container and including a cord spool and a spring motor that biases said cord spool to rotate in a cord-winding direction;

a pull cord having one end coupled to said cord spool, extending out of said container, and further having an opposite end coupled to the other one of said base rail and said header rail;

a braking unit disposed in said container and operatively associated with said cord spool and said pull cord for retaining releasably said base rail at a desired height relative to said header rail; and a one-way damper unit including:

a housing mounted to said container;

a unidirectional clutch disposed in said housing, forming a gap with said housing, and having:

a casing having an inner casing surface formed with a groove that extends at an angle with respect to an axis and that has a deep groove portion and a shallow groove portion angularly spaced apart from said deep groove portion, said shallow groove portion having a depth with respect to the axis that is shallower than that of said deep groove portion;

a main shaft having an insert segment extending into said casing along the axis, and a connecting segment extending from said insert segment outwardly of said casing; and a clutching member disposed in said casing and including: a fixing frame formed with a mounting slot; a clutching body disposed in said mounting slot, contacting said insert segment of said main shaft, and extending into said groove, said clutching body having a cross-sectional dimension shorter than a smallest distance between an outer surface of said insert segment and a groove bottom of said deep groove portion, and longer than a largest distance between said outer surface of said insert segment and a groove bottom of said shallow groove portion; and a spring member disposed between said fixing frame and said clutching body for biasing said clutching body toward said shallow groove portion;

a damping liquid that fills said gap between said housing and said unidirectional clutch; and a driven wheel coupled to said connecting segment of said main shaft and driven rotatably by said spring driving unit.

* * * * *